US007963461B2

(12) United States Patent
Köthen et al.

(10) Patent No.: US 7,963,461 B2
(45) Date of Patent: Jun. 21, 2011

(54) FUEL INJECTION NOZZLE

(75) Inventors: Dirk Köthen, Augsburg (DE); Gertrud Meggenrieder, Aystetten (DE); Dietmar Pinkernell, Gablingen (DE); Andreas Stichnoth, München (DE); Hakan Yalcin, Neu-Ulm (DE)

(73) Assignee: MAN B&W Diesel AG, Augsburg (DE)

( * ) Notice: Subject to any disclaimer, the term of this patent is extended or adjusted under 35 U.S.C. 154(b) by 1221 days.

(21) Appl. No.: 10/559,207

(22) PCT Filed: May 28, 2004

(86) PCT No.: PCT/EP2004/005770

§ 371 (c)(1),
(2), (4) Date: Dec. 2, 2005

(87) PCT Pub. No.: WO2004/106725

PCT Pub. Date: Dec. 9, 2004

(65) Prior Publication Data

US 2006/0124765 A1 Jun. 15, 2006

(30) Foreign Application Priority Data

Jun. 3, 2003 (DE) ..... 103 24 985

(51) Int. Cl.
*B05B 9/00* (2006.01)

(52) U.S. Cl. ..... 239/125; 239/128; 239/88; 239/132.2; 239/132; 239/533.2; 239/585.1

(58) Field of Classification Search ..... 239/128, 239/132, 133, 135, 88–93, 585.1, 585.3, 239/585.4, 585.5, 125, 585.2, 533.3
See application file for complete search history.

(56) References Cited

U.S. PATENT DOCUMENTS

| | | | | |
|---|---|---|---|---|
| 3,587,970 | A * | 6/1971 | Tindall et al. | 239/126 |
| 3,945,353 | A * | 3/1976 | Dreisin | 123/41.22 |
| 4,094,465 | A | 6/1978 | Bastenhof | |
| 5,570,580 | A * | 11/1996 | Mains | 60/747 |
| 5,577,386 | A * | 11/1996 | Alary et al. | 60/742 |
| 5,860,394 | A * | 1/1999 | Saito et al. | 123/41.31 |

(Continued)

FOREIGN PATENT DOCUMENTS

| | | |
|---|---|---|
| DE | 25 27 049 | 1/1977 |
| DE | 27 07 003 | 9/1977 |
| DE | 27 46 901 | 7/1978 |
| DE | 266 480 | 4/1989 |

(Continued)

OTHER PUBLICATIONS

Office Action dated May 18, 2005 issued for the corresponding German Application No. 103 24 985.0-13.

*Primary Examiner* — Dinh Q Nguyen
*Assistant Examiner* — Trevor E McGraw
(74) *Attorney, Agent, or Firm* — Cohen Pontani Lieberman & Pavane LLP

(57) ABSTRACT

Disclosed is a fuel injection nozzle comprising a cooling duct (6) that is disposed in the final region of a housing (1), which faces the combustion chamber. In order to cool the zones that are subjected to high thermal stress, the cooling duct (6) is positioned closer to the bore (2) of the valve needle than to the external face of the housing (1) and is provided with a cross-sectional area that has a width corresponding to no more than the height which extends in the axial direction of the nozzle.

2 Claims, 1 Drawing Sheet

U.S. PATENT DOCUMENTS

| | | | | |
|---|---|---|---|---|
| 6,273,032 | B1 * | 8/2001 | Ruoff et al. | 123/25 R |
| 6,889,284 | B1 * | 5/2005 | Nizar et al. | 710/315 |
| 7,028,918 | B2 * | 4/2006 | Buchanan et al. | 239/132.3 |
| 2002/0073707 | A1 * | 6/2002 | Lavie et al. | 60/730 |
| 2003/0010033 | A1 * | 1/2003 | Mansour et al. | 60/740 |
| 2005/0224601 | A1 * | 10/2005 | Baker et al. | 239/132.5 |

FOREIGN PATENT DOCUMENTS

| | | |
|---|---|---|
| EP | 0 845 592 | 12/1996 |
| EP | 0 961 025 | 12/1999 |
| GB | 755 316 | 8/1956 |
| GB | 1 488 566 | 10/1977 |

* cited by examiner

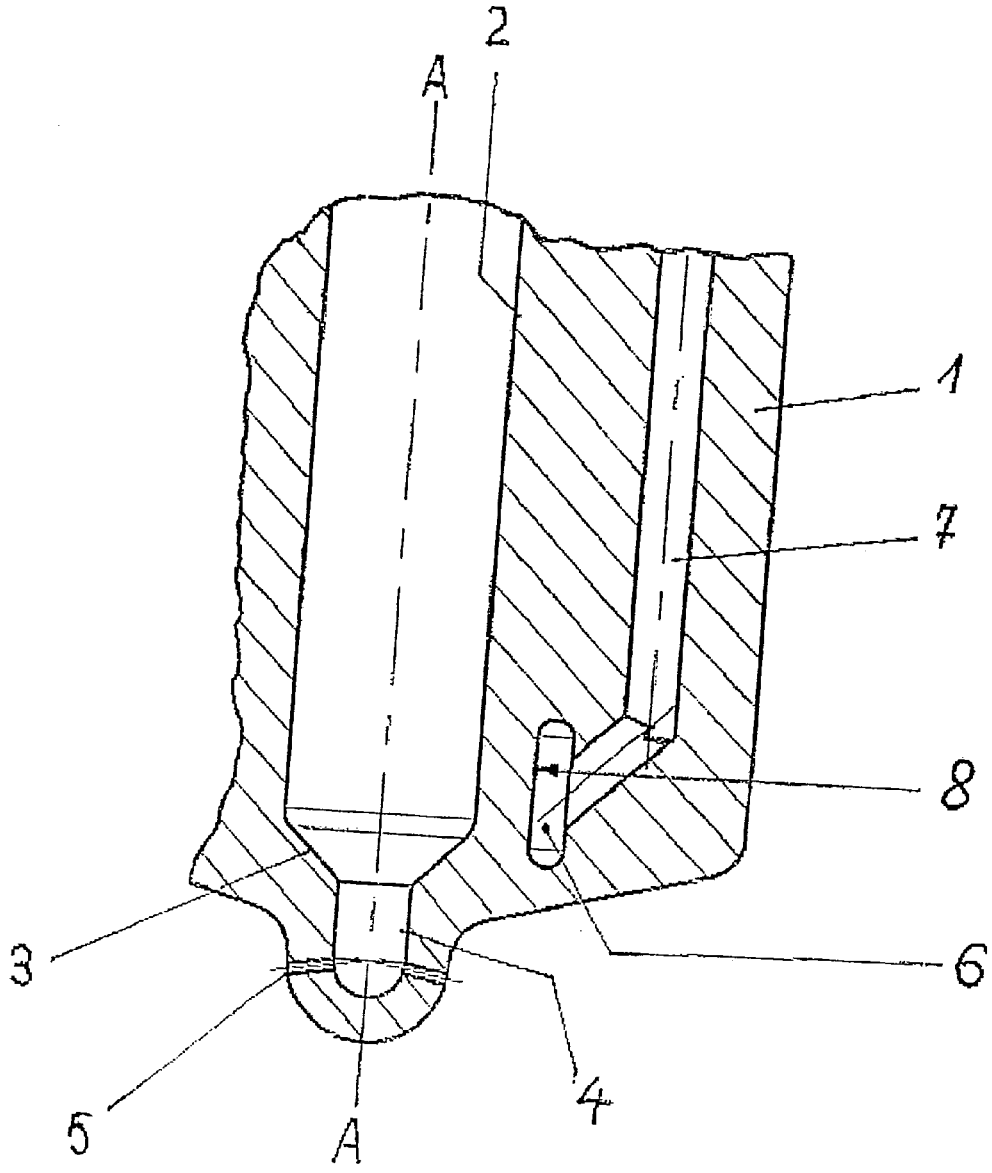
2
A
1
7
8
3
6
5
4
A

FUEL INJECTION NOZZLE

PRIORITY CLAIM

This is a U.S. national stage of application No. PCT/EP2004/005770, filed on 28 May 2004. Priority under 35 U.S.C. §119(a) and 35 U.S.C. §365(b) is claimed from German Application No. 103 24 985.0, filed 3 Jun. 2003.

BACKGROUND OF THE INVENTION

Field of the Invention

The invention relates to a fuel injection nozzle having a cooling duct which is arranged in the combustion chamber side end region of the housing.

SUMMARY OF THE INVENTION

The invention is based on the object of bringing about good cooling of the regions of the injection nozzle which are subjected to high thermal stress.

This is achieved according to the invention in that the cooling duct is arranged closer to the nozzle needle bore than to the outside of the housing and has a cross sectional face whose width is dimensioned so as to be at most equal to the height extending in the axial direction of the nozzle.

This measure allows the internal region of the nozzle to be cooled to a greater extent because the cooling medium can be brought closer to the parts which are subjected to high thermal stress. Also as a result of this, a relatively large wall surface of the cooling duct faces these parts. Furthermore, cold corrosion on the outside of the housing is avoided.

The width of the cooling duct is advantageously 0.1 to 0.9 times the height. According to one preferred embodiment, the width of the cooling duct is approximately 0.25 times the height.

The cooling duct preferably extends as far as the height of the nozzle needle seat on the combustion chamber side.

Further advantageous refinements and expedient developments of the superordinate measures can be found in the exemplary description given below with reference to the drawing.

BRIEF DESCRIPTION OF THE DRAWINGS

The single FIGURE of the drawing shows a vertical section through the parts of an injection nozzle which are essential according to the invention.

DETAILED DESCRIPTION OF THE PRESENTLY PREFERRED EMBODIMENTS

The nozzle has a housing 1 in which a nozzle needle bore 2 with a nozzle needle seat 3 is arranged along the axis A-A of said nozzle. The nozzle needle bore 2 is continuous with a fuel prestorage space 4 which leads to injection bores 5 which project into the combustion chamber (not illustrated).

A cooling duct 6 is arranged in the housing 1. The width of this cooling duct here is approximately 0.25 times the height extending in the direction of the axis A-A. The width of the cooling duct 6 will generally be dimensioned to be at most equal to the height. The width will preferably be selected in a range from 0.1 to 0.9 of the height. A cooling duct which is formed in this way may be made to extend to close to the combustion chamber, thus extending into the end region of the nozzle which is subjected to the highest thermal stress. Furthermore, a large wall surface 8 of the cooling duct 6 which faces the internal region of the nozzle is made available for the transfer of heat to the cooling water.

The cooling duct 6 is supplied with cooling medium by a cooling medium inflow line 7. The cross sectional area of the cooling duct 6 here is approximately twice the cross sectional area of the cooling medium inflow line 7. As a result, a relatively high flow rate of the cooling medium and thus a relatively large rate of dissipation of heat is brought about. Dead water regions are also avoided with this design.

As is shown by the statements above, the invention is not restricted to the illustrated exemplary embodiment.

What is claimed is:

1. A fuel injection nozzle comprising a housing, the housing comprising:

a nozzle needle bore having a central axis, an axial length, and a lower portion comprising a needle seat, an axial dimension of the lower portion being substantially smaller than the axial length of the bore;

an outside surface radially spaced from the axis;

a cooling duct arranged around the lower portion of the bore, the cooling duct being closer to the bore than to the outside surface of the housing, the cooling duct having a cross-sectional area in a plane through the central axis, the cross-sectional area having a height in the axial direction and a width transverse to the axis, the width being approximately 0.25 times the height, wherein an entire height of said cooling duct is arranged at said lower portion proximate said needle seat; and a cooling medium inflow line having a first portion extending axially in the housing and a second portion connecting the first portion to the cooling duct, the inflow line having a cross-sectional area, the cross-sectional area of the cooling duct being approximately twice the cross-sectional area of the inflow line.

2. The fuel injection nozzle of claim 1 wherein the cooling duct extends axially as far as the needle seat.

* * * * *